US008936479B2

(12) United States Patent
Yokoo

(10) Patent No.: US 8,936,479 B2
(45) Date of Patent: Jan. 20, 2015

(54) CONNECTOR HAVING FIRST AND SECOND TYPES OF CONTACTS WITH SUPPORT MEMBERS TO SUPPORT AN ACTUATOR

(71) Applicant: Japan Aviation Electronics Industry, Limited, Tokyo (JP)

(72) Inventor: Hiroyuki Yokoo, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 157 days.

(21) Appl. No.: 13/658,032

(22) Filed: Oct. 23, 2012

(65) Prior Publication Data

US 2013/0109218 A1 May 2, 2013

(30) Foreign Application Priority Data

Nov. 1, 2011 (JP) ..... 2011-240042

(51) Int. Cl.
*H01R 13/15* (2006.01)
*H01R 12/88* (2011.01)

(52) U.S. Cl.
CPC ..... *H01R 12/88* (2013.01)
USPC ..... 439/260

(58) Field of Classification Search
CPC ..... H01R 13/6275; H01R 13/6395; H01R 13/639; H01R 13/627; H01R 13/62; H01R 23/668; H01R 12/79; H01R 12/88
USPC ..... 439/260, 345
See application file for complete search history.

(56) References Cited

U.S. PATENT DOCUMENTS

| | | | | |
|---|---|---|---|---|
| 7,083,455 | B1 * | 8/2006 | Miura et al. | 439/260 |
| 7,112,079 | B2 * | 9/2006 | Miura et al. | 439/260 |
| 7,344,399 | B2 * | 3/2008 | Iijima et al. | 439/260 |
| 7,727,006 | B1 * | 6/2010 | Huang | 439/495 |
| 7,946,872 | B2 * | 5/2011 | Taketomi et al. | 439/260 |

(Continued)

FOREIGN PATENT DOCUMENTS

| | | | |
|---|---|---|---|
| JP | 2004-193045 | A | 7/2004 |
| JP | 2005-183010 | A | 7/2005 |

(Continued)

OTHER PUBLICATIONS

Korean Office Action dated Aug. 29, 2013 (and English translation thereof) in counterpart Korean Application No. 10-2012-0116412.

*Primary Examiner* — Amy Cohen Johnson
*Assistant Examiner* — Vladimir Imas
(74) *Attorney, Agent, or Firm* — Holtz, Holtz, Goodman & Chick PC

(57) ABSTRACT

A connector is connectable to an inserted object. The connector comprises a housing and an actuator. The actuator is supported by the housing so as to pivot between an open position where the object is insertable and a close position where the inserted object is held. The actuator has a supported shaft, a first supported portion and a second supported portion which are supported by a pivot supporter, a first support member and a second support member of the connector, respectively. The first supported portion is in abutment with the first support member located thereabove both when the actuator is located at the open position and when the actuator is located at the close position. The second supported portion is in abutment with the second support member located therebelow both when the actuator is located at the open position and when the actuator is located at the close position.

12 Claims, 11 Drawing Sheets

(56) References Cited

U.S. PATENT DOCUMENTS

| | | | | |
|---|---|---|---|---|
| 8,128,425 | B2 * | 3/2012 | Takahashi et al. | 439/260 |
| 8,177,571 | B2 * | 5/2012 | Yokoo et al. | 439/260 |
| 8,182,277 | B2 * | 5/2012 | Yokoo et al. | 439/260 |
| 8,337,226 | B2 * | 12/2012 | Yokoo | 439/260 |
| 8,435,059 | B2 * | 5/2013 | Honda et al. | 439/260 |
| 8,512,058 | B2 * | 8/2013 | Ozeki | 439/260 |
| 8,535,076 | B2 * | 9/2013 | Okamura | 439/325 |
| 8,651,893 | B2 * | 2/2014 | Ogura et al. | 439/495 |
| 8,662,915 | B2 * | 3/2014 | Ueda et al. | 439/493 |
| 8,672,698 | B2 * | 3/2014 | Sasaki et al. | 439/260 |
| 2011/0028018 | A1 * | 2/2011 | Yokoo et al. | 439/329 |
| 2012/0045919 | A1 * | 2/2012 | Yokoo | 439/345 |

FOREIGN PATENT DOCUMENTS

| | | | |
|---|---|---|---|
| JP | 2007-299586 | A | 11/2007 |
| JP | 2008-218255 | A | 9/2008 |

* cited by examiner

CONNECTOR HAVING FIRST AND SECOND TYPES OF CONTACTS WITH SUPPORT MEMBERS TO SUPPORT AN ACTUATOR

CROSS REFERENCE TO RELATED APPLICATIONS

Applicants claim priority under 35 U.S.C. §119 of Japanese Patent Applications No. JP2011-240042 filed Nov. 1, 2011.

BACKGROUND OF THE INVENTION

This invention relates to a connector comprising an actuator which is operable to be opened and closed. Especially, this invention relates to the aforementioned connector which is connectable to a sheet-like or board-like object (for example, a Flexible Printed Circuit (FPC) or a Flexible Flat Cable (FFC)). The sheet-like or board-like object may be provided with a holding member attached to an end thereof.

For example, this type of connector is disclosed in JP-A 2004-193045 (see FIG. 26), contents of which are incorporated herein by reference.

The connector of JP-A 2004-193045 comprises a housing, a plurality of contacts and an actuator. The housing is provided with two first support portions. Each of the contacts is integrally formed with a resiliently deformable second support portion. The actuator has two first shafts provided at opposite end thereof and a plurality of second shafts located between the first shafts. The first shafts are supported by the respective first support portions from below while the second shafts are supported from above (i.e. pressed downward) by the respective second support portions. The center of the pivot of the first shaft is out of alignment with the center of the pivot of the second shaft so that the second shaft is gently prevented from pivoting by the second support portion. Accordingly, the actuator of the connector of JP-A 2004-193045 is prevented from unintentionally pivoting.

As the sheet-like or board-like object has more conductive lines, a size in a pitch direction (i.e. a length) of the actuator becomes larger (i.e. becomes longer). The actuator of the connector of JP-A 2004-193045 may be easily bent. If the actuator is too long. In other words, the connector of JP-A 2004-193045 has a problem that the actuator is unable to keep a proper posture because the actuator is easily bent.

SUMMARY OF THE INVENTION

It is therefore an object of the present invention to provide a connector comprising an actuator prevented from pivoting unintentionally, wherein the actuator is not easily bent even when an object which is connectable to the connector has many conductive lines so that the actuator is able to keep a proper posture.

One aspect of the present invention provides a connector connectable to an object which is inserted therein. The connector comprises a housing, a plurality of contacts, a first support member, a second support member and an actuator. The housing has a pivot supporter. The contacts are held by the housing so as to be arranged in a pitch direction. The first support member is held by the housing. The second support member is held by the housing. The actuator has a supported shaft corresponding to the pivot supporter, a first supported portion corresponding to the first support member and a second supported portion corresponding to the second support member. The actuator is movable between an open position where the object is insertable into the connector and a close position where the object is kept in a connected state where the object is connected to the connector. The first supported portion is brought into contact with the first support member located thereabove both when the actuator is located at the open position and when the actuator is located at the close position. The second supported portion is brought into contact with the second support member located therebelow both when the actuator is located at the open position and when the actuator is located at the close position. The supported shaft presses the pivot supporter downward when the actuator moves from the open position toward the close position so that the actuator receives an upward reaction force. The first supported portion pushes up the first support member when the actuator receives the reaction force. The second supported portion is temporally apart from the second support member when the actuator receives the reaction force.

An appreciation of the objectives of the present invention and a more complete understanding of its structure may be had by studying the following description of the preferred embodiment and by referring to the accompanying drawings.

Figure 1:
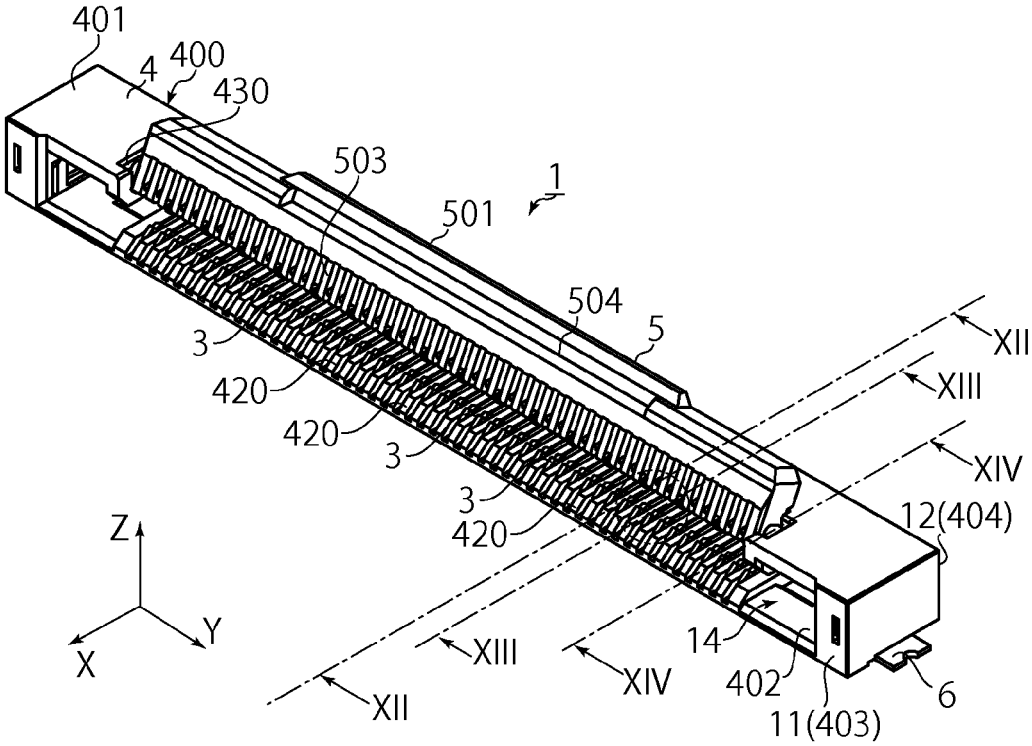
FIG. 1 is a front, perspective view showing a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
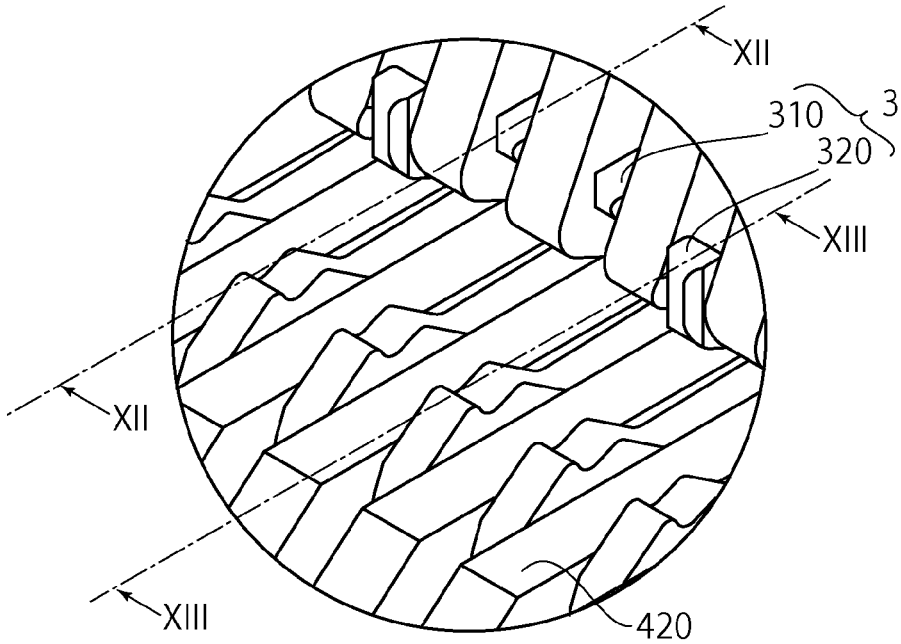
FIG. 2 is partially enlarged, perspective view showing about an insertion opening (a part enclosed by a circle of dashed-dotted lines) of the connector of FIG. 1.
Figure 3:
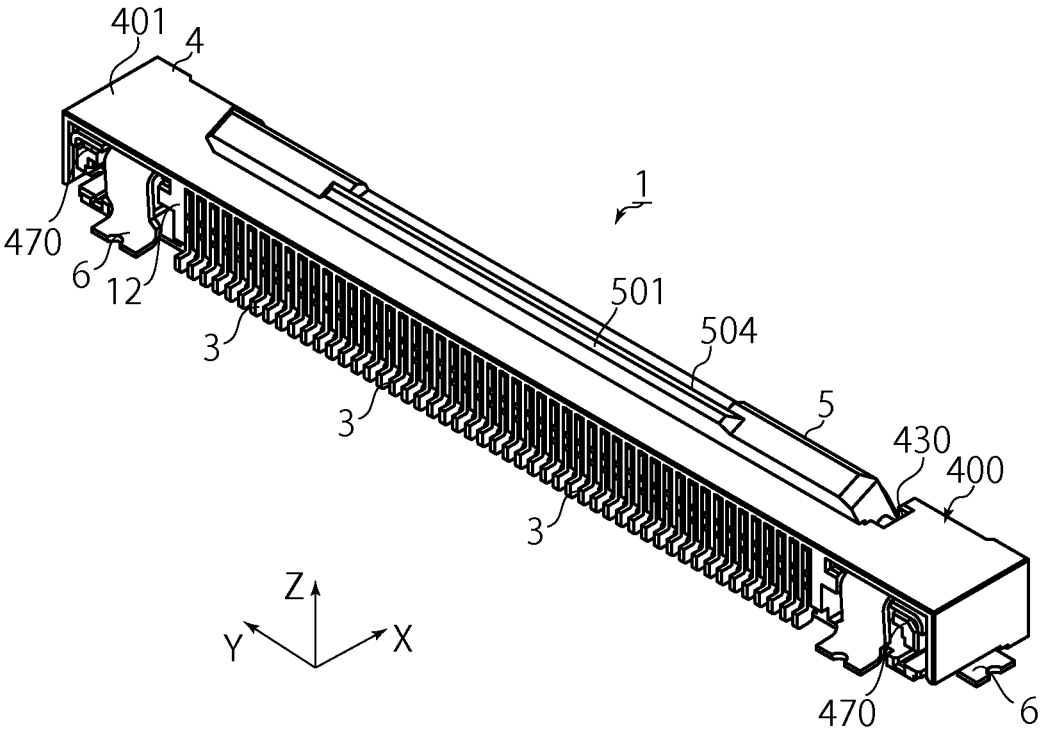
FIG. 3 is a rear, perspective view showing the connector of FIG. 1.
Figure 24:
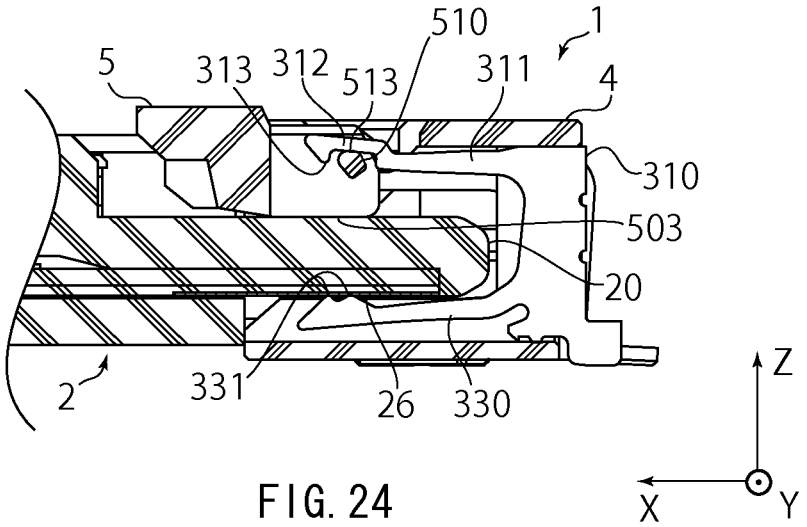
FIG. 24 is a cross-sectional view showing the connector of FIG. 21 and the plug connector of FIG. 4 in a state where the plug connector is inserted in the connector.
Figure 25:
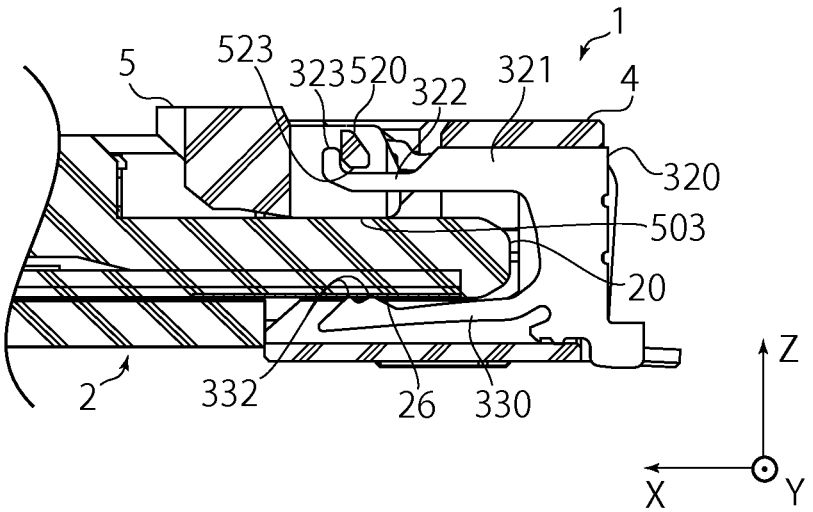
FIG. 25 is a cross-sectional view showing the connector of FIG. 22 and the plug connector of FIG. 4 in the state where the plug connector is inserted in the connector.
Figure 26:
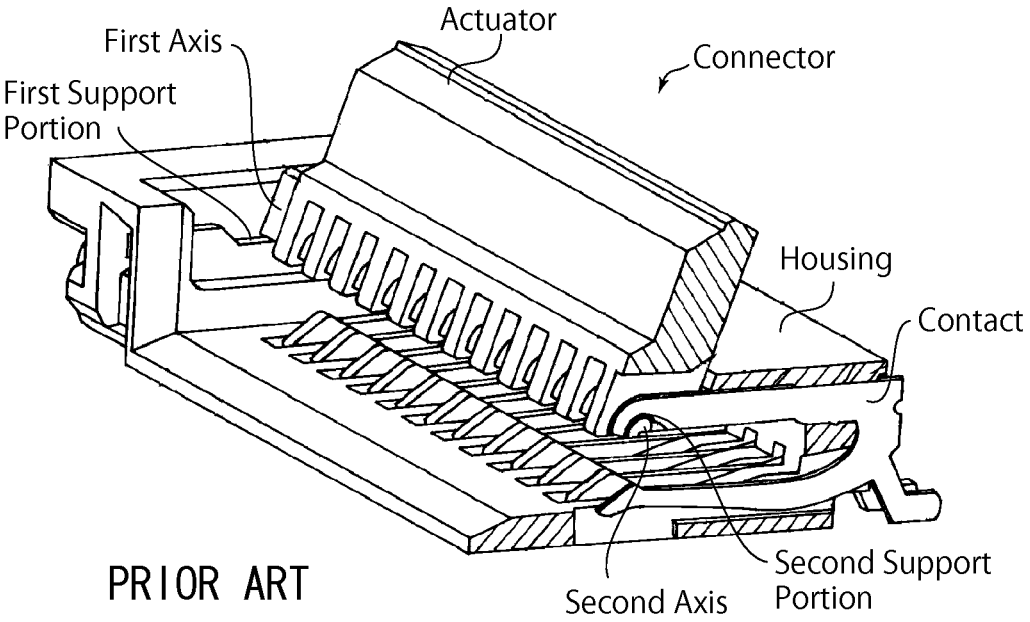
PRIOR ART FIG. 26
FIG. 26 is a perspective view showing an existing connector.

Hereinafter, as referring to FIGS. 1 to 25, it is described about a connector 1 of an embodiment of the present invention. As shown in FIGS. 1 to 3, the connector 1 according to the present embodiment has a cuboid shape extending slenderly in the Y-direction (pitch direction). The connector 1 is configured to be installed on a circuit board (not shown). In detail, the connector 1 according to the present embodiment comprises a plurality of contacts 3 each made of a metal, a housing 4 made of an insulating material, an actuator 5 made of an insulating material and two hold-downs 6 each made of a metal. The contacts 3 are held by the housing 4 so as to be arranged in the Y-direction. The actuator 5 is attached to the housing 4 so as to be supported by the contacts 3. The connector 1 is connectable to a plug connector (object) 2 (see FIGS. 4 and 5) which is inserted therein. In detail, the connector 1 has a front end 11 and a rear end 12 in the X-direction (front-to-rear direction). The connector 1 is provided with an insertion opening 14 at the front end 11 thereof. The plug connector 2 is connected to the connector 1 when inserted into the connector 1 toward the rear end 12 of the connector 1 through the insertion opening 14. Hereinafter, except when FIG. 24 or 25 is referred, it is described about various parts of the connector 1 under a state where the plug connector 2 is not inserted in nor connected to the connector 1.

Figure 4:
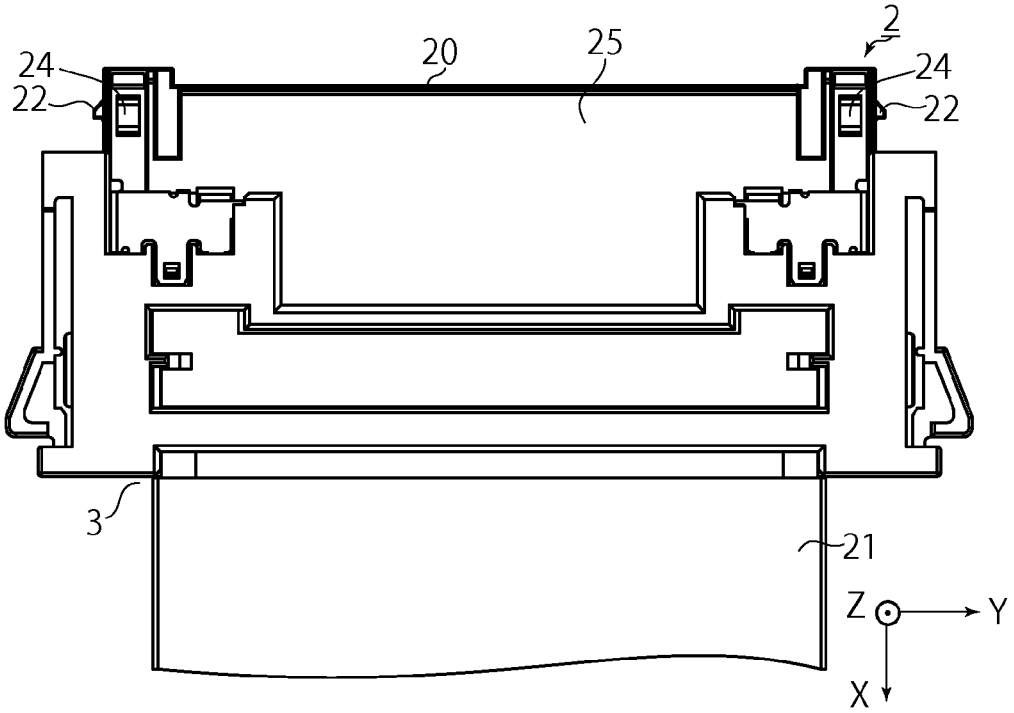
FIG. 4 is a top view showing a plug connector (an object) which is connectable to the connector of FIG. 1.
Figure 5:
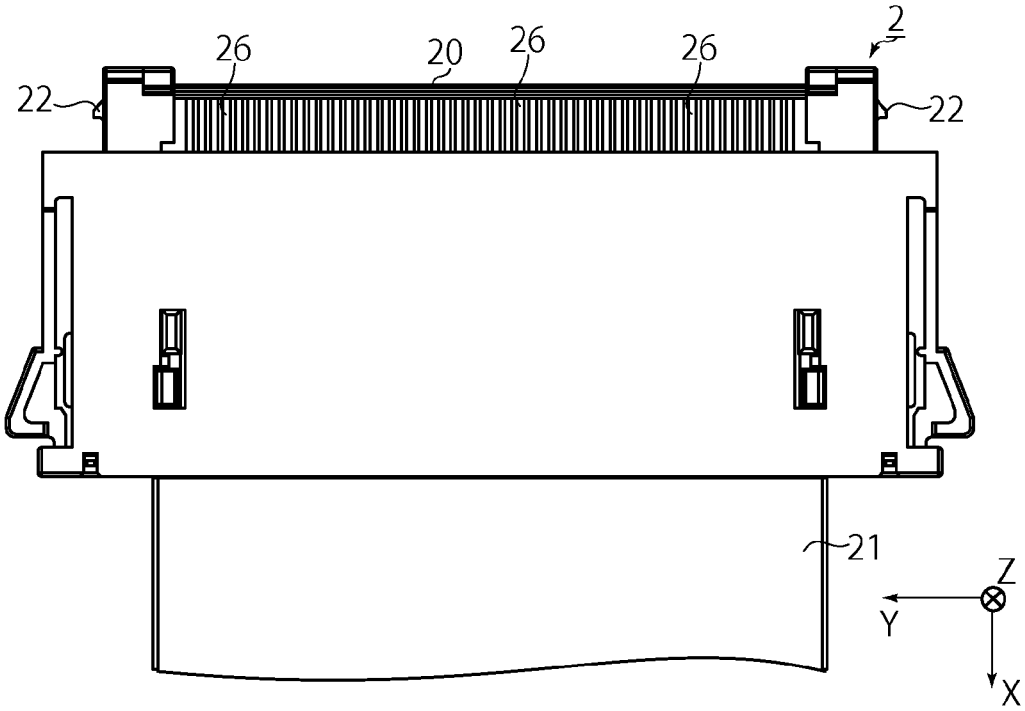
FIG. 5 is a bottom view showing the plug connector of FIG. 4.

As shown in FIGS. 4 and 5, the plug connector 2 connectable to the connector 1 according to the present embodiment is attached to an end of an FPC 21. In other words, according to the present embodiment, the object connectable to the connector 1 is the plug connector 2 comprising the FPC 21. However, the object may be the FPC 21 itself which is not attached to the plug connector 2. The plug connector 2 has a mating portion 20 which is configured to be inserted into the insertion opening 14 of the connector 1 (i.e. configured to be inserted into the connector 1). The mating portion 20 is provided with two mating lock portions 22 on opposite ends thereof in the Y-direction, respectively. The mating lock portions 22 protrude outward in the Y-direction. The mating portion 20 has two ground portions 24. The ground portions 24 are provided with in the vicinity of the mating lock portions 22, respectively. The mating portion 20 further has a plurality of signal conducts 26. The signal conducts 26 are provided on a lower surface of the mating portion 20.

Figure 14:
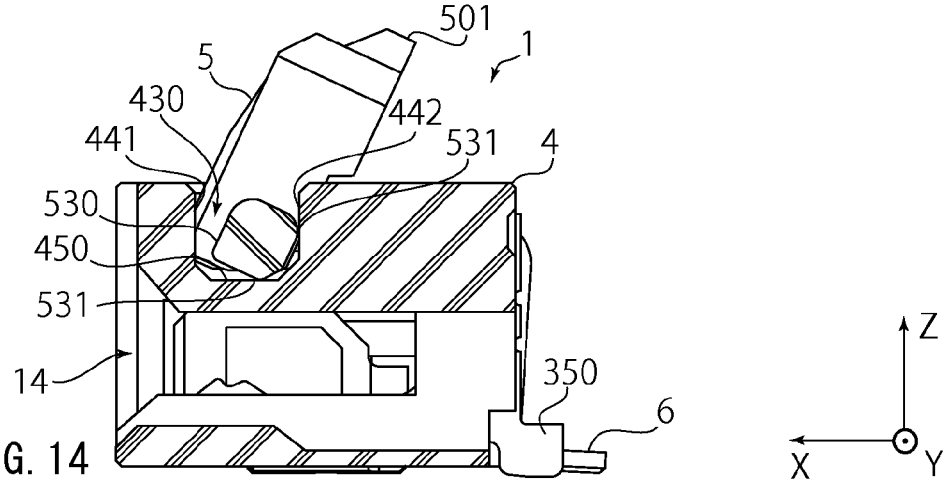
FIG. 14 is a cross-sectional view showing the connector of FIG. 1, taken along lines XIV-XIV, wherein the actuator is located at the open position.

As shown in FIGS. 1 to 3, the housing 4 has a body portion 400. The body portion 400 has a cuboid shape which is long in the Y-direction. The body portion 400 is formed with an upper portion 401, a bottom portion 402, a front end 403 and a rear end 404. According to the present embodiment, the front end 403 is the front end 11 of the connector 1, and the rear end 404 is the rear end 12 of the connector 1. The bottom portion 402 is formed with a plurality of holding walls 420. The holding walls 420 are arranged in the Y-direction so as to arrange and hold the contacts 3 in the Y-direction. The front end 403 is partially recessed toward the rear end 404 (i.e. in the negative X-direction) so that the upper portion 401 is formed with a recess having a square bracket-like shape. The recess is formed at a middle part of the front end 403 of the upper portion 401 in the Y-direction so that the actuator 5 is attachable to the housing 4. As described later, the actuator 5 has two supported shafts 530 (see FIG. 7). The housing 4 further has two pivot supporters 430 which correspond to the respective supported shafts 530. The pivot supporters 430 are formed on opposite ends of the recess in the Y-direction, respectively. Referring to FIGS. 1 and 14, each of the pivot supporters 430 is a ditch surrounded by a side surface 441 nearer to the front end 403, a side surface 442 nearer to the rear end 404, and a bottom surface 450. The housing 4 according to the present embodiment further has two holding portions 470. The holding portions 470 are formed in the vicinity of the rear end 404 of the housing 4 in the Y-direction, respectively.

Figure 6:
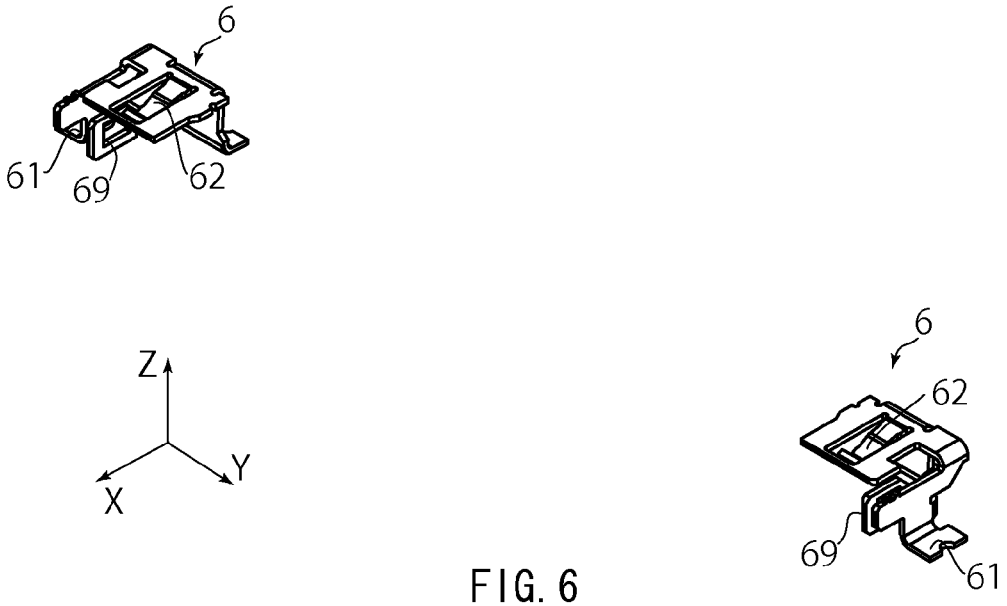
FIG. 6 is a perspective view showing hold-downs of the connector of FIG. 1.

As shown in FIGS. 1, 3 and 6, the hold-down 6 is configured to fix and connect the connector 1 to the circuit board (not shown). The hold-downs 6 according to the present embodiment are inserted into the respective holding portions 470 toward the front end 403 so as to be attached to the housing 4. Each of the hold-down 6 has a soldered portion 61, a ground contact 62 and a lock portion 69. In detail, an upper part of the hold-down 6 partially extends downward (i.e. in the negative Z-direction). The soldered portion 61 is formed so as to extend continuously from the aforementioned downward extending portion. The soldered portion 61 extends to be away from the connector 1 in the Y-direction. The ground contact 62 extends from the upper part of the hold-down 6 obliquely downward and forward (i.e. in the positive X-direction). The ground contact 62 of the hold-down 6 and the ground portion 24 of the plug connector 2 are electrically connected with each other when the connector 1 and the plug connector 2 are connected to each other. The hold-down 6 according to the present embodiment is formed by bending a single metal sheet. The lock portion 69 is a hole formed on the hold-down 6. In other words, the lock portion 69 according to the present embodiment is integrally formed with the hold-down 6. The lock portions 69 are configured to lock a connected state, where the plug connector 2 is connected to the connector 1, together with the mating lock portions 22. More specifically, the lock portions 69 are interlocked with the respective mating lock portions 22 under the connected state so that the connected state is locked (i.e. kept). As described above, the lock portion 69 according to the present embodiment is integrally formed with the hold-down 6. Moreover, the hold-down 6 is soldered to the circuit board (not shown) under the connected state. Accordingly, it is possible to more securely prevent the plug connector 2 from coming off the connector 1.

As shown in FIGS. 7 to 11, the actuator 5 has a body portion 500. The body portion 500 has a board-like shape which is long in the Y-direction. The body portion 500 is formed with an operation portion 501, a pivoting portion 502 and a pressing portion 503. The pressing portion 503 presses the plug connector 2 under the connected state (see FIG. 24). As described later, the actuator 5 according to the present embodiment is configured to be movable between an open position (see FIGS. 12 to 14) where the plug connector 2 is insertable into the connector 1 and a close position (see FIGS. 21 to 24) where the plug connector 2 is kept in the connected state (see FIG. 24).

The operation portion 501 is operable so that the actuator 5 moves between the close position and the open position. The operation portion 501 has a recessed portion 504 formed on a lower part thereof so that it is possible to more easily raise the actuator 5 located at the close position (i.e. move the actuator 5 toward the open position).

The pivoting portion 502 has a plurality of first supported portions 510 and a plurality of second supported portions 520 in addition to the aforementioned two supported shafts 530. The pivoting portion 502 is provided with a plurality of partition walls 505 so that the pivoting portion 502 has a comb-like shape as a whole. As can be seen from FIGS. 7 to 9, either the first supported portion 510 or the second supported portion 520 is provided within a gap between the two partition walls 505 which are adjacent to each other in the Y-direction. In other words, the pivoting portion 502 is formed with a plurality of first gaps each provided with the first supported portion 510, and a plurality of second gaps each provided with the second supported portion 520. The supported shafts 530 protrude outward in the Y-direction from opposite ends of the body portion 500 (i.e. the actuator 5) in the Y-direction, respectively. According to the present embodiment, the first supported portions 510 and the second supported portions 520 are located between the two supported shafts 530 in the Y-direction.

Figure 7:
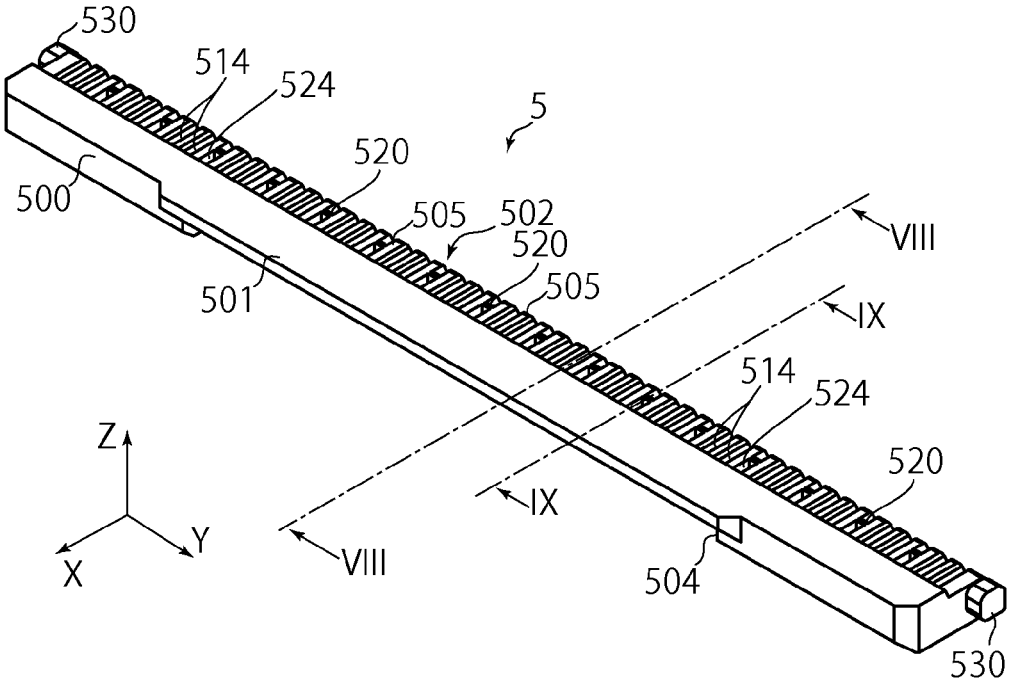
FIG. 7 is a perspective view showing an actuator of the connector of FIG. 1.
Figure 8:
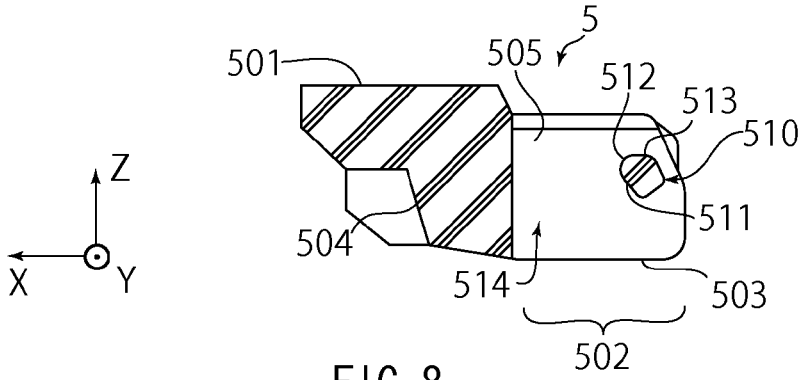
FIG. 8 is a cross-sectional view showing the actuator of FIG. 7, taken along lines VIII-VIII.

As shown in FIGS. 7 and 8, the first supported portion 510 has a polygonal cross-section in the XZ-plane. In detail, the first supported portion 510 has a pressed portion 511, a pressing portion 512 and a pressed portion 513. Each of the pressed portion 511 and the pressed portion 513 has a planar shape. The pressing portion 512 has a curved shape. The two partition walls 505 that face each other in the Y-direction across the first gap, which has the first supported portion 510, are connected to each other only by the first supported portion 510. As shown in FIG. 8, the first supported portion 510 has the cross-section separated from the operation portion 501 in the XZ-plane. In detail, the pivoting portion 502 has a space 514 which is formed between the first supported portion 510 and the operation portion 501. The space 514 serves as the accommodating portion 514 which accommodates a part of the contact 3.

Figure 9:
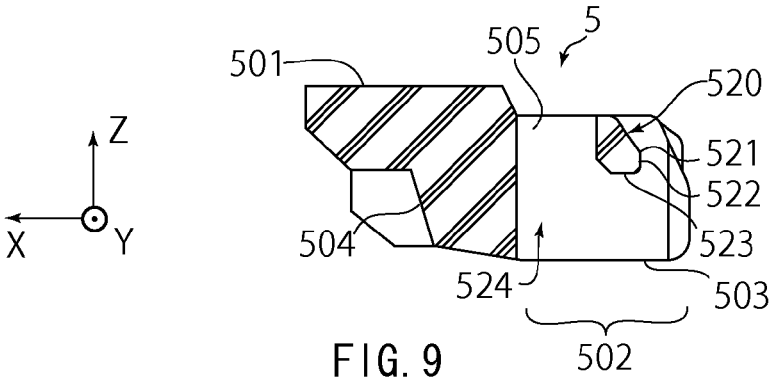
FIG. 9 is a cross-sectional view showing the actuator of FIG. 7, taken along lines IX-IX.

As shown in FIGS. 7 and 9, the second supported portion 520 has a polygonal cross-section in the XZ-plane. In detail, the second supported portion 520 has a supported portion 521, a pressing portion 522 and a supported portion 523. The supported portion 521 is an obtuse corner. Each of the pressing portion 522 and the supported portion 523 has a planar shape. The two partition walls 505 that face each other in the Y-direction across the second gap, which has the second supported portion 520, are connected to each other only by the second supported portion 520. As shown in FIG. 9, the second supported portion 520 has the cross-section separated from the operation portion 501 in the XZ-plane. In detail, the pivoting portion 502 has a space 524 which is formed between the second supported portion 520 and the operation portion 501.

Figure 10:
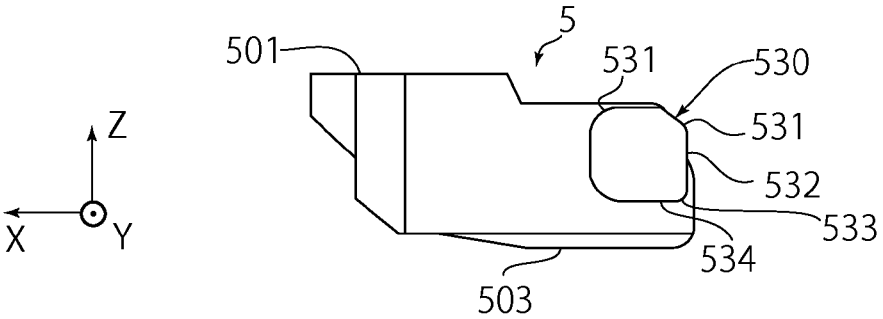
FIG. 10 is a side view showing the actuator of FIG. 7.

As shown in FIGS. 7 and 10, the supported shaft 530 has a cross-section having a rounded rectangular shape in the XZ-plane. In detail, the supported shaft 530 has two abutment portions 531, a first side surface 532, a pressing portion 533 and a second side surface 534. When the actuator 5 is located at the open position, the two abutment portions 531 are in contact with the side surface 442 and the bottom surface 450 of the pivot supporter 430 of the housing 4, respectively (see FIG. 14). Each of the first side surface 532 and the second side surface 534 has a planar shape. The pressing portion 533 is a rounded corner of the supported shaft 530. Any one of distances between the pivot center of the supported shaft 530 and the two abutment portions 531 is longer than any one of distances between the pivot center and the two side surfaces (i.e. the first side surface 532 and the second side surface 534).

Figure 11:
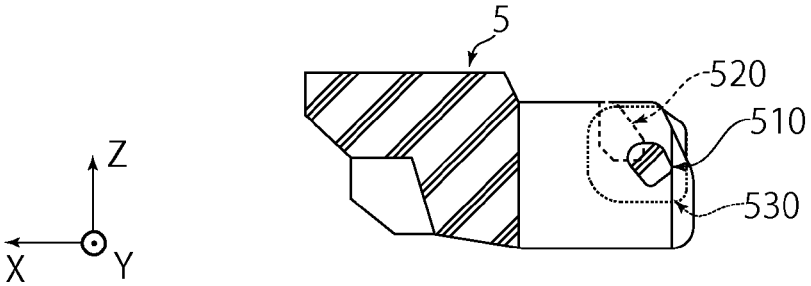
FIG. 11 is another cross-sectional view showing the actuator of FIG. 7, taken along lines VIII-VIII, wherein hidden outlines of a second supported portion and a supported shaft of the actuator are illustrated by dashed lines.

As shown in FIG. 11, according to the present embodiment, the first supported portion 510, the second supported portion 520 and the supported shaft 530 are provided at different positions from one another in the XZ-plane.

Figure 12:
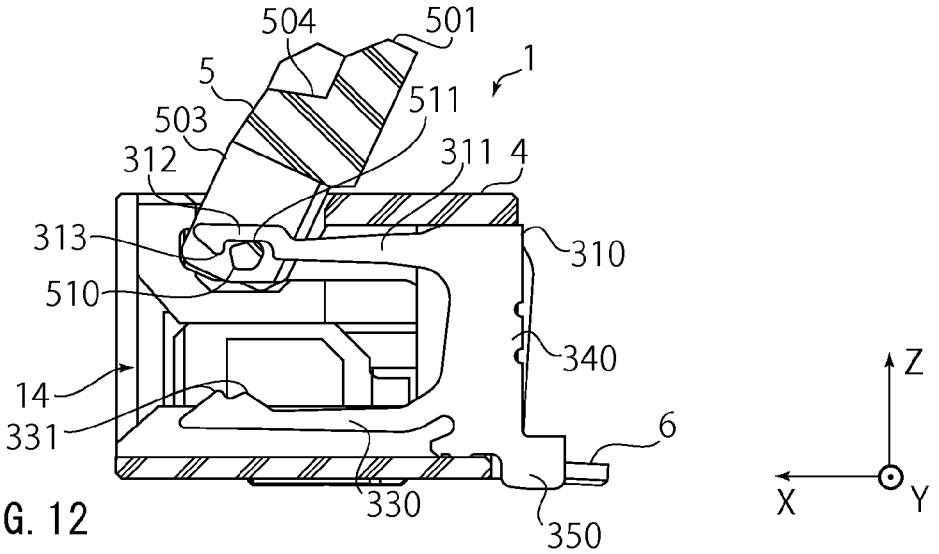
FIG. 12 is a cross-sectional view showing the connector of FIG. 1, taken along lines XII-XII, wherein the actuator is located at an open position.
Figure 13:
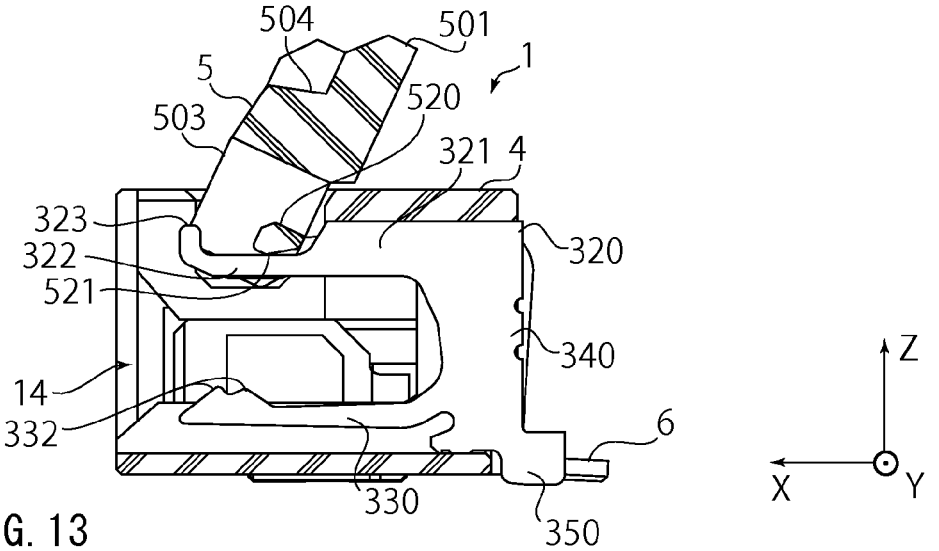
FIG. 13 is a cross-sectional view showing the connector of FIG. 1, taken along lines XIII-XIII, wherein the actuator is located at the open position.

As shown in FIGS. 1, 12 and 13, the contacts 3 according to the present embodiment consist of a plurality of first contacts 310 and a plurality of second contacts 320. According to the present embodiment, a ratio of the first contacts 310 and the second contacts 320 of the connector 1 is 2:1.

As shown in FIG. 12, the first contact 310 has a forked shape (i.e. rotated U-like shape) extending forward (i.e. in the positive X-direction). In detail, the first contact 310 has a press-fitted portion 340, a first arm 311 and a lower arm 330. The press-fitted portion 340 is press fitted in the housing 4 so that the first contact 310 is fixed to the housing 4. The first arm 311 extends forward from an upper end part of the press-fitted portion 340. The lower arm 330 extends forward from a lower end part of the press-fitted portion 340. The first arm 311 is formed with a first abutment portion (first support member) 312 and a first engaged portion 313. The first abutment portion 312 extends forward continuously from the first arm 311 while being curved to protrude upward (i.e. in the positive Z-direction). The first engaged portion 313 is provided on the leading end of the first abutment portion 312 so as to be located forward of the first supported portion 510. The first engaged portion 313 protrudes downward. As can be seen from the above description, the connector 1 comprises the first support member 312 which corresponds to the first supported portion 510 of the actuator 5 (see FIG. 12). The first support member 312 is held by the housing 4 at the rear end 404 of the housing 4 so as to extend toward the front end 403 of the housing 4. The first support member 312 according to the present embodiment is integrally formed with the first contact 310. However, the first support member 312 may be formed separately from the first contact 310. The lower arm 330 has a first contact portion 331 formed about the leading end thereof. The first contact portion 331 is a protrusion protruding upward. The press-fitted portion 340 is provided with a fixed portion 350. The fixed portion 350 is formed in the vicinity of the lower end of the press-fitted portion 340 so as to extend rearward (i.e. in the negative X-direction) from the rear end of the press-fitted portion 340. The fixed portion 350 is fixed to a signal pattern (not shown) of the circuit board (not shown), for example, by soldering when the connector 1 is installed to the circuit board.

As shown in FIG. 13, similar to the first contact 310, the second contact 320 has a forked shape (i.e. rotated U-like shape) extending forward. In detail, similar to the first contact 310, the second contact 320 has the press-fitted portion 340 and the lower arm 330. The press-fitted portion 340 is press fitted in the housing 4 so that the second contact 320 is fixed to the housing 4. The lower arm 330 extends forward from the lower end part of the press-fitted portion 340. The second contact 320 further has a second arm 321. Similar to the first arm 311, the second arm 321 extends forward from the upper end part of the press-fitted portion 340. However, the second arm 321 has different structures from the first arm 311. More specifically, the second arm 321 is formed with a second abutment portion (second support member) 322 and a second engaged portion 323. The second abutment portion 322 extends forward continuously from the second arm 321 while being curved to protrude downward (i.e. in the negative Z-direction). The second engaged portion 323 is provided on the leading end of the second support member 322 so as to be located forward of the second supported portion 520. The second engaged portion 323 protrudes upward. As can be seen from the above description, the connector 1 comprises the second support member 322 which corresponds to the second supported portion 520 of the actuator 5 (see FIG. 13). The second support member 322 is held by the housing 4 at the rear end 404 of the housing 4 so as to extend toward the front end 403 of the housing 4. The second support member 322 according to the present embodiment is integrally formed with the second contact 320. However, the second support member 322 may be formed separately from the second contact 320. The lower arm 330 has a second contact portion 332 formed about the leading end thereof. The second contact portion 332 according to the present embodiment has the same structure as the first contact portion 331. More specifically, the second contact portion 332 is a protrusion protruding upward similar to the first contact portion 331. The press-fitted portion 340 is provided with the fixed portion 350. The fixed portion 350 is formed in the vicinity of the lower end of the press-fitted portion 340 so as to extend rearward from the rear end of the press-fitted portion 340. As described above, according to the present embodiment, the first contact 310 and the second contact 320 have the same structure as each other except the first arm 311 and the second arm 321.

The connector 1 according to the present embodiment is configured as described above so that the actuator 5 is operable to pivot from the open position to the close position.

As shown in FIGS. 12 to 14, the actuator 5 protrudes upward (more specifically, obliquely upward) from an upper surface of the housing 4 when located at the open position so that the plug connector 2 is insertable into the insertion opening 14 of the connector 1. When the actuator 5 is located at the open position, the pressed portion 511 of the first supported portion 510 is in abutment with the first abutment portion 312 of the first contact 310 to be pressed downward (see FIG. 12). The supported portion 521 of the second supported portion 520 is supported by the second abutment portion 322 of the second contact 320 (see FIG. 13). Moreover, the supported shaft 530 is in abutment with the pivot supporter 430. In detail, the two abutment portions 531 of the supported shaft 530 are in contact with the side surface 442 and the bottom surface 450 of the pivot supporter 430, respectively (see FIG. 14). As described above, when the actuator 5 is located at the open position, the first supported portion 510 receives a downward force from the first abutment portion 312 of the first contact 310 while the second supported portion 520 is supported by the second abutment portion 322 of the second contact 320 so that the actuator 5 is supported. In other words, the actuator 5 located at the open position is held by the first contact 310 and the second contact 320. Considering the aforementioned holding structure, the supported shaft 530 may be apart from the pivot supporter 430 (i.e. may be lifted above the pivot supporter 430). In other words, the actuator 5 located at the open position may be held only by the first contact 310 and the second contact 320. However, if the supported shaft 530 is located above the pivot supporter 430, the second supported portion 520 moves downward when the actuator 5 receives a downward force. As a result, the second contact 320 which supports the second supported portion 520 from below may receive a large load so that the second contact 320 might be damaged. Accordingly, it is preferred that supported shaft 530 be supported by the pivot supporter 430.

Figure 15:
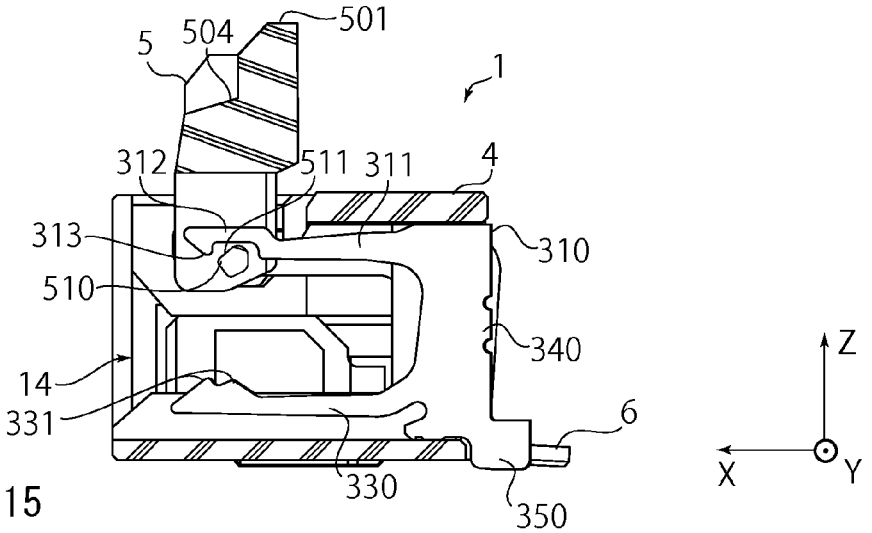
FIG. 15 is a cross-sectional view showing the connector of FIG. 12 in a state where the actuator is turned forward (i.e. in a state where the actuator is located between the open position and a close position).
Figure 16:
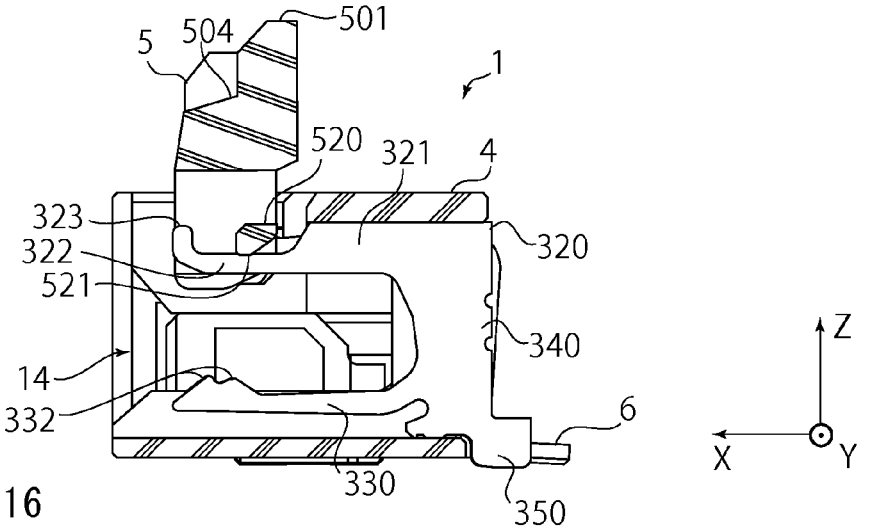
FIG. 16 is a cross-sectional view showing the connector of FIG. 13 in the state where the actuator is turned forward.
Figure 17:
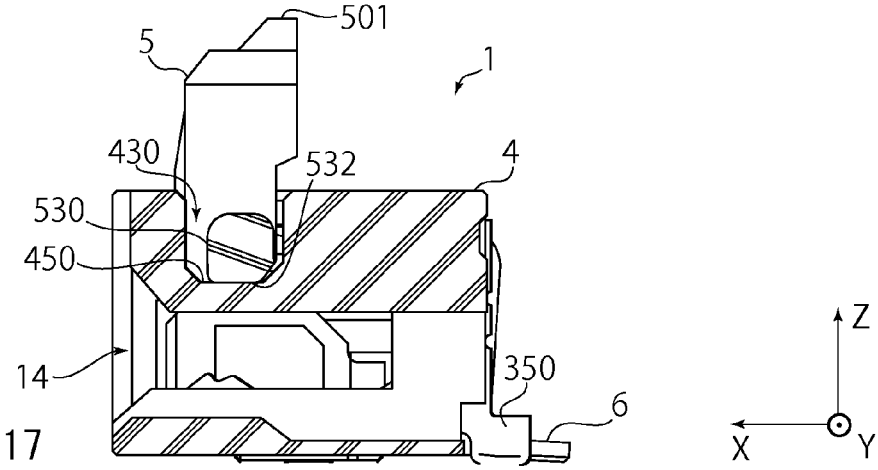
FIG. 17 is a cross-sectional view showing the connector of FIG. 14 in the state where the actuator is turned forward.

As shown in FIGS. 15 to 17, when the actuator 5 moves from the open position to the close position, the actuator 5 passes through an upright state where the actuator 5 stands upright from the housing 4. More specifically, the actuator 5 at the open position is operated to pivot forward so that the actuator 5 transfers in the upright state. Under the upright state, the first supported portion 510 temporally moves downward so as to be apart from the first abutment portion 312. In other words, the first supported portion 510 and the first abutment portion 312 are not in contact with each other (see FIG. 15). Under the upright state, the second supported portion 520 temporally moves downward so as to press the second abutment portion 322 (see FIG. 16). In the meantime, the first side surface 532 of the supported shaft 530 is in contact with the bottom surface 450 of the pivot supporter 430 (see FIG. 17). However, the actuator 5 under the upright state may be supported only by an abutment of the second supported portion 520 with the second abutment portion 322. In other words, the first side surface 532 of the supported shaft 530 may not be in contact with the bottom surface 450 of the pivot supporter 430.

Figure 18:
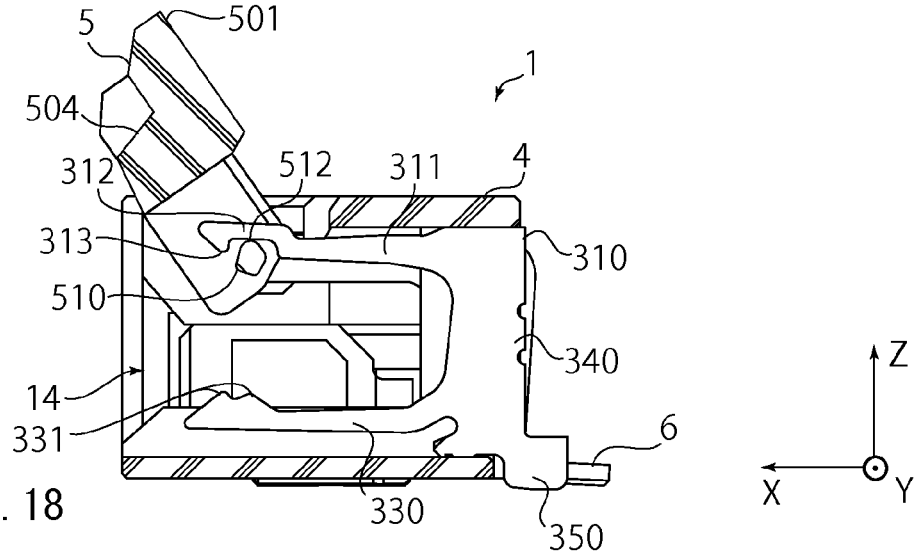
FIG. 18 is a cross-sectional view showing the connector of FIG. 15 in a state where the actuator is further turned forward (i.e. in another state where the actuator is located between the open position and the close position).
Figure 19:
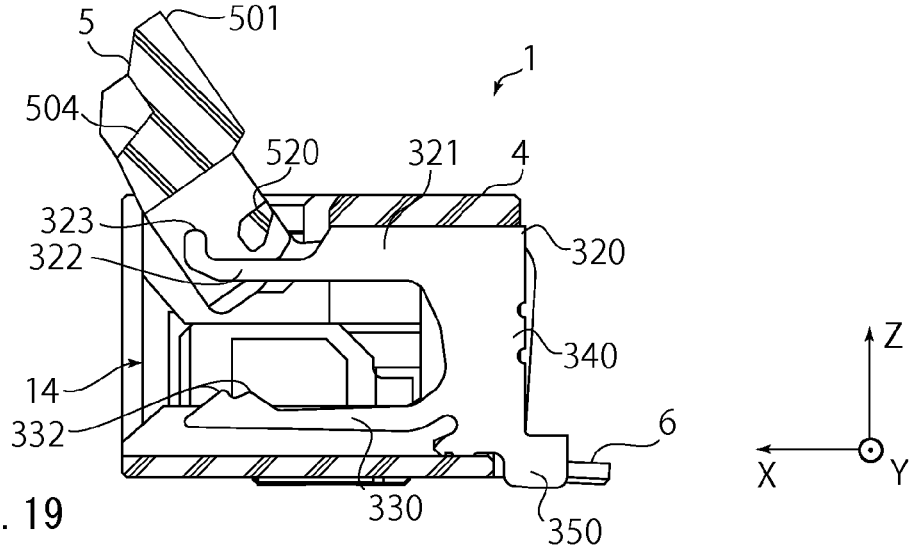
FIG. 19 is a cross-sectional view showing the connector of FIG. 16 in the state where the actuator is further turned forward.
Figure 20:
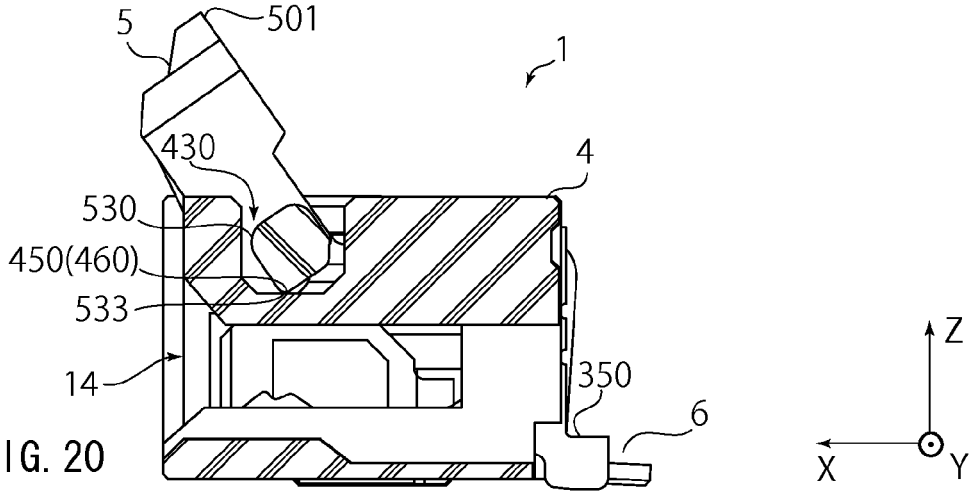
FIG. 20 is a cross-sectional view showing the connector of FIG. 17 in the state where the actuator is further turned forward.

As shown in FIGS. 18 to 20, the supported shaft 530 presses the pivot supporter 430 downward when the actuator 5 under the upright state moves toward the close position (i.e. when the actuator 5 moves from the open position toward the close position) so that the actuator 5 receives an upward reaction force. In detail, when the actuator 5 in the upright state is further turned forward, the pressing portion 533 of the supported shaft 530 presses the pressed portion 460 (i.e. a part of the bottom surface 450). Then, the actuator 5 receives the reaction force from the pressed portion 460 (see FIG. 20). The pressing portion 512 of the first supported portion 510 presses upward and pushes up the first abutment portion 312 of the first contact 310 when the actuator 5 receives the reaction force. Accordingly, the first arm 311 of the first contact 310 is resiliently deformed (see FIG. 18). In the meantime, the second supported portion 520 temporally moves upward so as to be apart from the second abutment portion 322. In other words, the second supported portion 520 and the second abutment portion 322 are not in contact with each other (see FIG. 19). According to the present embodiment, the actuator 5 is prevented from further turning forward, provided that such a force which further deforms the first contact 310 resiliently is not applied to the actuator 5. In other words, the actuator 5 is prevented from unintentionally moving to the close position. Moreover, a click feeling may be generated when the actuator 5 is turned forward beyond a position shown in FIGS. 18 to 20. As can be seen from the above description, this click feeling is generated because the first supported portion 510 presses the first contact 310. According to the present embodiment, the pressing portion 533 of the supported shaft 530 presses a fixed surface (i.e. the pressed portion 460 of the pivot supporter 430). The reaction force received from this fixed surface is used when the first supported portion 510 presses the first contact 310. Accordingly, it is possible to more firmly press the first abutment portion 312 of the first contact 310. The click feeling is therefore more clearly generated. According to the present embodiment, when the first supported portion 510 presses the first contact 310, the second supported portion 520 is apart from the second contact 320. In other words, a part (i.e. the second abutment portion 322 of the second contact 320) which is configured to be moved by the second supported portion 520 is not pressed. As can be seen from the above description, all of the reaction force, which is applied to the pressing portion 533 of the supported shaft 530 by the pressed portion 460 of the pivot supporter 430, is transferred to the first contact 310 through the first supported portion 510. According to the present embodiment, when the actuator 5 is located at the position shown in FIGS. 18 to 20, the second supported portion 520 is temporally apart from the second contact 320 while only the two parts (i.e. the supported shaft 530 and the first supported portion 510) are brought into contact with the pivot supporter 430 and the first contact 310, respectively. Accordingly, it is possible to transfer all of the aforementioned reaction force to the first contact 310.

Figure 21:
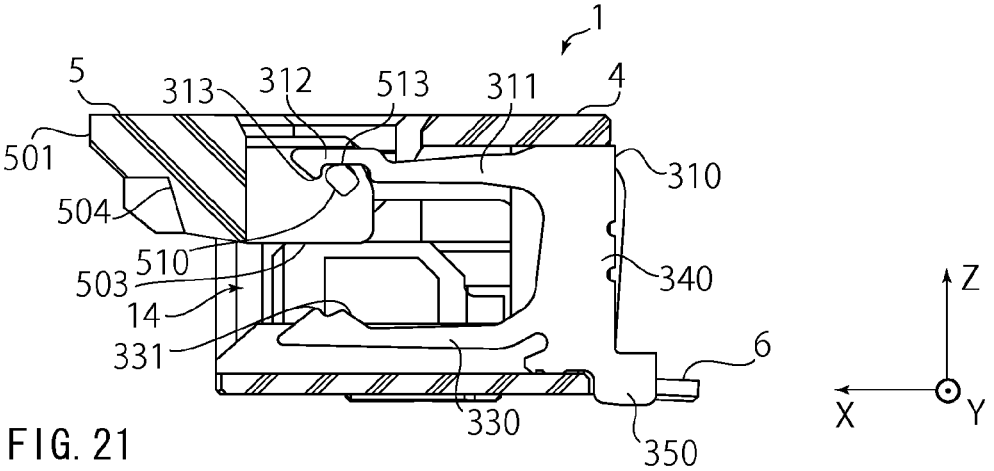
FIG. 21 is a cross-sectional view showing the connector of FIG. 18 in a state where the actuator is fully turned (i.e. in a state where the actuator is located at the close position).
Figure 22:
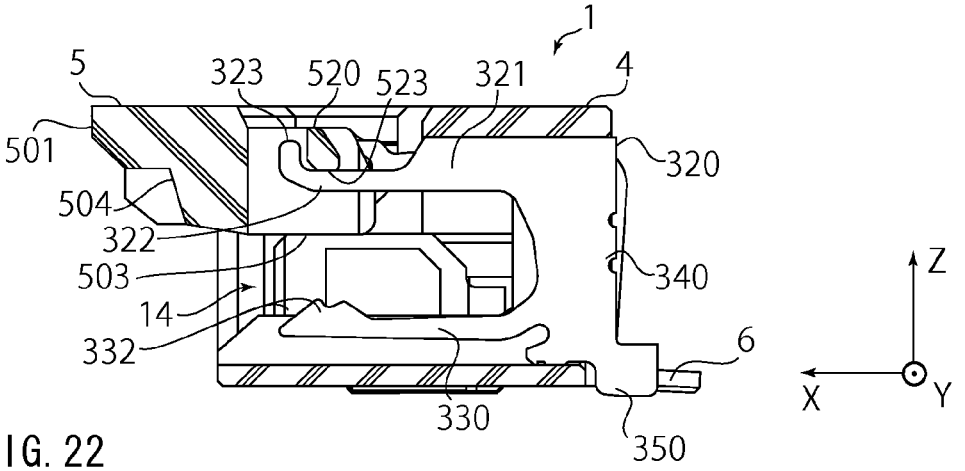
FIG. 22 is a cross-sectional view showing the connector of FIG. 19 in the state where the actuator is fully turned.
Figure 23:
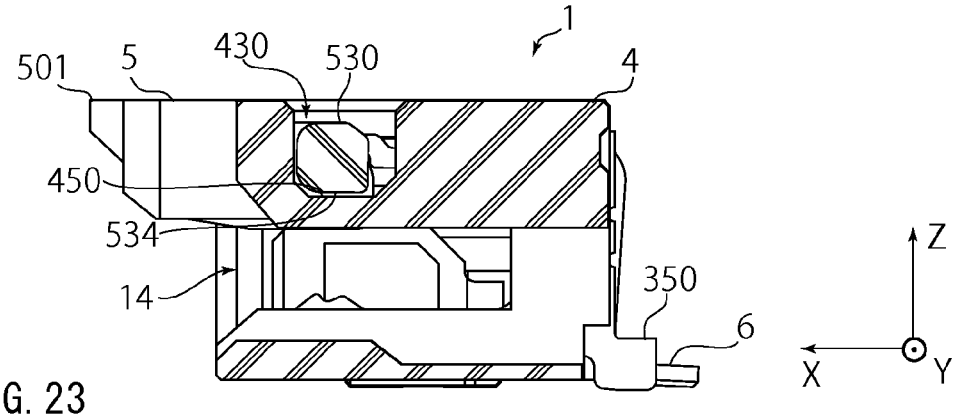
FIG. 23 is a cross-sectional view showing the connector of FIG. 20 in the state where the actuator is fully turned.

As shown in FIGS. 21 to 23, when the actuator 5 is turned to be in parallel to the X-direction (i.e. when the actuator 5 is located at the close position), the first supported portion 510 is brought into contact with the first abutment portion 312 of the first contact 310, and the second supported portion 520 is brought into contact with the second abutment portion 322 of the second contact 320. In the meantime, the supported shaft 530 is slightly apart from the pivot supporter 430. According to the present embodiment, the actuator 5 at the close position is supported only by the first contact 310 and the second contact 320. However, the supported shaft 530 and the pivot supporter 430 may be in contact with each other. In this case, the second contact 320 may be prevented from being damaged even when an unintentional force is applied to the actuator 5 from above.

As shown in FIGS. 24 and 25, when the actuator 5 is located at the close position, the plug connector 2 is held by the connector 1 so that the connected state is maintained more securely. More specifically, the pressing portion 503 of the actuator 5 receives a reaction force from the mating portion 20 of the plug connector 2 when the actuator 5 is located at the close position under a mating state where the connector 1 and the plug connector 2 are mated with each other. The first supported portion 510, which receives this reaction force, presses the first contact 310 upward (see FIG. 24). Moreover, each of the first contact portion 331 of the first contact 310 and the second contact portion 332 of the second contact 320 receives the reaction force from the mating portion 20 of the plug connector 2 to be resiliently deformed downward (see FIGS. 24 and 25). In the meantime, each of the signal conducts 26 is brought into contact with and electrically connected to the corresponding first contact portion 331 or the corresponding second contact portion 332. In other words, the first contacts 310 and the second contacts 320 according to the present embodiment are provided so that the first contact portions 331 and the second contact portions 332 are brought into contact with the plug connector 2 from below. According to the present embodiment, the connected state of the connector 1 with the mating portion 20 of the plug connector 2 is kept more securely by forces applied from above by the first arms 311 of the first contacts 310 and forces applied from below by the lower arms 330 of the first contacts 310 and the lower arms 330 of the second contacts 320.

As described above, according to the present embodiment, when the actuator is located at the open position, the first supported portion 510 and the second supported portion 520 of the actuator 5 (i.e. at least two kinds of parts of the actuator 5) are in contact with the first contact 310 and the second contact 320, respectively (see FIGS. 12 to 14). When the actuator 5 pivots (i.e. moves) to arrive at the upright state, at least the second supported portion 520 is brought into contact with the second contact 320 (see FIGS. 15 to 17). When the actuator 5 further pivots, only the supported shaft 530 and the first supported portion 510 (i.e. only two kinds of parts of the actuator 5) are brought into contact with the pivot supporter 430 and the first contact 310, respectively (see FIGS. 18 to 20). When the actuator 5 arrives at the close position, the first supported portion 510 and the second supported portion 520 (i.e. at least two kinds of parts of the actuator 5) are brought into contact with the first contact 310 and the second contact 320, respectively (see FIGS. 21 to 23). As described above, the first supported portion 510 is in contact (or in abutment) with the first support member 312 located thereabove both when the actuator 5 is located at the open position and when the actuator 5 is located at the close position (see FIGS. 12 and 21). Moreover, the second supported portion 520 is in contact (or in abutment) with the second support member 322 located therebelow both when the actuator 5 is located at the open position and when the actuator 5 is located at the close position (see FIGS. 13 and 22). In other words, the actuator 5 either at the open position or the close position is pressed by the first contacts 310 from above while supported by the second contacts 320 from below. The actuator 5 either at the open position or the close position is supported by the first support members 312 and the second support members 322 configured as described above so that the actuator 5 does not bend excessively. In other words, it is possible to keep a proper posture of the actuator 5. Moreover, the second supported portion 520 is temporally leaves from the second support member 322 as the actuator 5 pivots so that an unintentional pivot of the actuator 5 is prevented. Accordingly, the keeping of the proper posture of the actuator and the prevention of unintentional pivot of the actuator 5 are compatible with each other.

Moreover, according to the present embodiment, the first contact 310 and the second contact 320 are provided with the first engaged portion 313 and the second engaged portion 323, respectively, so that the actuator 5 is prevented from coming out forward at any position between the open position and the close position.

As shown in FIG. 1, the connector 1 according to the present embodiment comprises a plurality of first sets each consisting of the first support member 312 (i.e. the first contact 310) and the first supported portion 510, and a plurality of second sets each consisting of the second support member 322 (i.e. the second contact 320) and the second supported portion 520. According to the present embodiment, the first sets and the second sets are used at a ratio of 2:1. However, this ratio may be designed properly to meet various conditions such as an intensity of the click feeling and a strength of the force which is necessary for the actuator 5 to press the plug connector 2 (see FIG. 4).

The present application is based on a Japanese patent applications of JP2011-240042 filed before the Japan Patent Office on Nov. 1, 2011, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector connectable to an object which is inserted therein, the connector comprising:

a housing having a pivot supporter; and a plurality of contacts held by the housing so as to be arranged in a pitch direction, the plurality of contacts consisting of a plurality of first contacts and a plurality of second contacts, and the connector having no types of contacts other than the first contacts and second contacts;

wherein each of the plurality of first contacts is integrally formed with a first support member held by the housing;

wherein each of the plurality of second contacts is integrally formed with a second support member held by the housing; and wherein the connector further comprises:

an actuator having a supported shaft corresponding to the pivot supporter, a first supported portion corresponding to the first support member and a second supported portion corresponding to the second support member, the actuator being movable between an open position where the object is insertable into the connector and a close position where the object is kept in a connected state in which the object is connected to the connector, the first supported portion being brought into contact with the first support member located thereabove both when the actuator is located at the open position and when the actuator is located at the close position, the second supported portion being brought into contact with the second support member located therebelow both when the actuator is located at the open position and when the actuator is located at the close position, the supported shaft pressing the pivot supporter downward when the actuator moves from the open position toward the close position so that the actuator receives an upward reaction force, the first supported portion pushing up the first support member when the actuator receives the reaction force, and the second supported portion being temporarily apart from the second support member when the actuator receives the reaction force.

2. The connector as recited in claim 1, the connector comprising two of the supported shafts, wherein:

the supported shafts project outward from opposite ends in the pitch direction of the actuator, respectively; and the first supported portion and the second supported portion are located between the supported shafts in the pitch direction.

3. The connector as recited in claim 1, the connector comprising:

a plurality of first sets each consisting of the first support member and the first supported portion; and a plurality of second sets each consisting of the second support member and the second supported portion.

4. The connector as recited in claim 1, wherein:

the actuator protrudes upward or obliquely upward from an upper surface of the housing when located at the open position; and the supported shaft is in abutment with the pivot supporter when the actuator is located at the open position.

5. The connector as recited in claim 4, wherein:

when the actuator moves from the open position to the close position, the actuator passes an upright state where the actuator stands upright from the housing; and under the upright state, the first supported portion temporarily moves downward so as to be apart from the first support member while the second supported portion temporarily moves downward so as to press the second support member.

6. The connector as recited in claim 1, wherein:

each of the first contacts has a first contact portion;

each of the second contacts has a second contact portion; and the first contacts and the second contacts are provided so that the first contact portions and the second contact portions thereof are brought into contact with the object from below.

7. The connector as recited in claim 1, wherein:

the second support member is held by the housing at a rear end of the housing so as to extend toward a front end of the housing; and the second support member is provided with a second engaged portion, the second engaged portion being located forward of the second supported portion and extending upward.

8. The connector as recited in claim 1, wherein:

the first support member is held by the housing at a rear end of the housing so as to extend toward a front end of the housing; and the first support member is provided with a first engaged portion, the first engaged portion being located forward of the first supported portion and extending downward.

9. The connector as recited in claim 1, wherein:

the actuator has an operation portion, the operation portion being operable so that the actuator moves between the close position and the open position; and each of the first supported portion and the second supported portion has a cross-section separated from the operation portion in a plane perpendicular to the pitch direction.

10. The connector as recited in claim 1, wherein the supported shaft has a cross-section having a rounded rectangular shape in a plane perpendicular to the pitch direction.

11. The connector as recited in claim 1, the connector further comprising a lock portion, wherein:

the object has a mating portion which is configured to be inserted into the connector;

the mating portion is provided with two mating lock portions on opposite ends thereof in the pitch direction, respectively; and the lock portion is configured to lock the connected state together with the mating lock portions.

12. The connector as recited in claim 11, the connector comprising a hold down which is configured to be connected and fixed to a circuit board, wherein:

the lock portion is integrally formed with the hold down.

* * * * *